US005275099A

United States Patent [19]

Kawagoe

[11] Patent Number: 5,275,099

[45] Date of Patent: Jan. 4, 1994

[54] APPARATUS FOR CONTROLLING CONTACT PRESSURE BETWEEN ROTATING MEMBERS

[75] Inventor: Akihiko Kawagoe, Ibaraki, Japan

[73] Assignee: Komori Corporation, Japan

[21] Appl. No.: 979,295

[22] Filed: Nov. 20, 1992

[30] Foreign Application Priority Data

Nov. 22, 1991 [JP] Japan ..... 3-103738[U]

[51] Int. Cl.[5] ..... B41F 5/00

[52] U.S. Cl. ..... 101/216; 101/247

[58] Field of Search ..... 101/216, 184, 185, 247, 101/232, 218; 100/99, 210, 295, 296

[56] References Cited

U.S. PATENT DOCUMENTS

| | | | |
|---|---|---|---|
| 4,171,949 | 10/1979 | Endersen et al. | 432/104 |
| 4,855,062 | 8/1989 | Oelbermann | 210/228 |
| 4,993,319 | 2/1991 | Klappenecker | 101/216 |
| 5,010,516 | 4/1991 | Sarda | 101/232 |
| 5,081,927 | 1/1992 | Jahn | 101/184 |
| 5,174,039 | 12/1992 | Murai | 33/504 |
| 5,181,468 | 1/1993 | Borel | 101/216 |
| 5,201,272 | 4/1993 | Simon | 101/216 |
| 5,215,008 | 6/1993 | Kartovaara et al. | 100/99 |

*Primary Examiner*—Edgar S. Burr
*Assistant Examiner*—Ren Yan
*Attorney, Agent, or Firm*—Blakely, Sokoloff, Taylor & Zafman

[57] ABSTRACT

An apparatus for controlling a contact pressure between a plate cylinder and a form roller includes a roller arm, an actuator, a plate, and strain gauges. The roller arm supports the form roller to be movable with respect to the plate cylinder. The actuator moves the roller arm so as to adjust a contact pressure applied by the form roller to the plate cylinder. The plate is brought into contact with an end shaft portion of the form roller and supported on a machine frame. The strain gauges detect a displacement of the plate to generate a signal.

6 Claims, 2 Drawing Sheets

APPARATUS FOR CONTROLLING CONTACT PRESSURE BETWEEN ROTATING MEMBERS

BACKGROUND OF THE INVENTION

The present invention relates to an apparatus for controlling a contact pressure between two rotating members and, more particularly, to an apparatus of each of an inking arrangement and a dampening arrangement of a printing press, which controls a contact pressure between a form roller or a form dampening roller and the surface of a plate mounted on a plate cylinder.

Each of various types of printing presses, e.g., an offset rotary press, has an inking arrangement and a dampening arrangement for supplying an ink and dampening water (to be referred to as water hereinafter), respectively, to the surface of a plate mounted on a plate cylinder. The inking arrangement has an ink fountain roller rotating in an ink fountain containing an ink, and a large number of rollers disposed between the ink fountain roller and the plate cylinder such that their circumferential surfaces contact each other. The ink picked up from the ink fountain upon rotation of the ink fountain roller is uniformly distributed in the respective directions while it is transferred among the rollers, and is supplied to the plate surface on the plate cylinder by the form roller serving as the last one of the rollers.

The dampening arrangement has a water fountain roller rotating in a water fountain containing water, and a plurality of rollers disposed between the water fountain roller and the plate cylinder such that their circumferential surfaces contact each other. Water picked up from the water fountain upon rotation of the water fountain roller is uniformly distributed in the respective directions while it is transferred among the plurality of rollers, and is supplied to the plate surface on the plate cylinder by the form dampening roller serving as the last roller. An image is formed on the plate surface with the ink and water supplied to it, and is transferred on paper directly or through a blanket cylinder, thereby printing the image.

When the contact pressure between the form roller and the plate surface or between the form dampening roller and the plate surface is changed to an inappropriate value as a whole or to cause non-uniformity between the right and left sides of the plate surface, the ink or water attaches to the plate surface excessively, insufficiently, or non-uniformly. Then, a high printing quality cannot be obtained. Therefore, the form roller or the form dampening roller is supported by the free end portions of roller arms, and rotation of the roller arms is adjusted, thereby adjusting the contact pressure.

However, in order to check whether the contact pressure adjustment is appropriately performed or not, conventionally, a piece of paper serving as a gauge is inserted between the form roller or form dampening roller and the plate surface, and the resistance caused when the piece of paper is being pulled out is manually checked. Alternatively, an ink or the like is coated on the form roller, this roller is rotated to transfer the ink or the like on the plate surface, and the width of a thick line transferred on the plate surface is read by a gauge. Thus, the contact pressure cannot be obtained as a quantitative unit of force, and a satisfactory result cannot always be respected.

SUMMARY OF THE INVENTION

It is an object of the present invention to provide an apparatus for controlling a contact pressure between rotating members, that can detect the contact pressure between the rotating members as a signal indicating a pressure.

It is another object of the present invention to provide an apparatus for controlling a contact pressure between rotating members, that can appropriately correct the contact pressure between the rotating members.

In order to achieve the above objects, according to the present invention, there is provided an apparatus for controlling a contact pressure between rotating members, comprising a support member for supporting a second rotating member to be movable with respect to a first rotating member, driving means for moving the support member so as to adjust a contact pressure applied by the second rotating member to the first rotating member, a plate-like member brought into contact with an end shaft portion of the second rotating member and supported on a machine frame, and a sensor for detecting a displacement of the plate-like member to generate a signal.

DESCRIPTION OF THE PREFERRED EMBODIMENT

Figure 1:
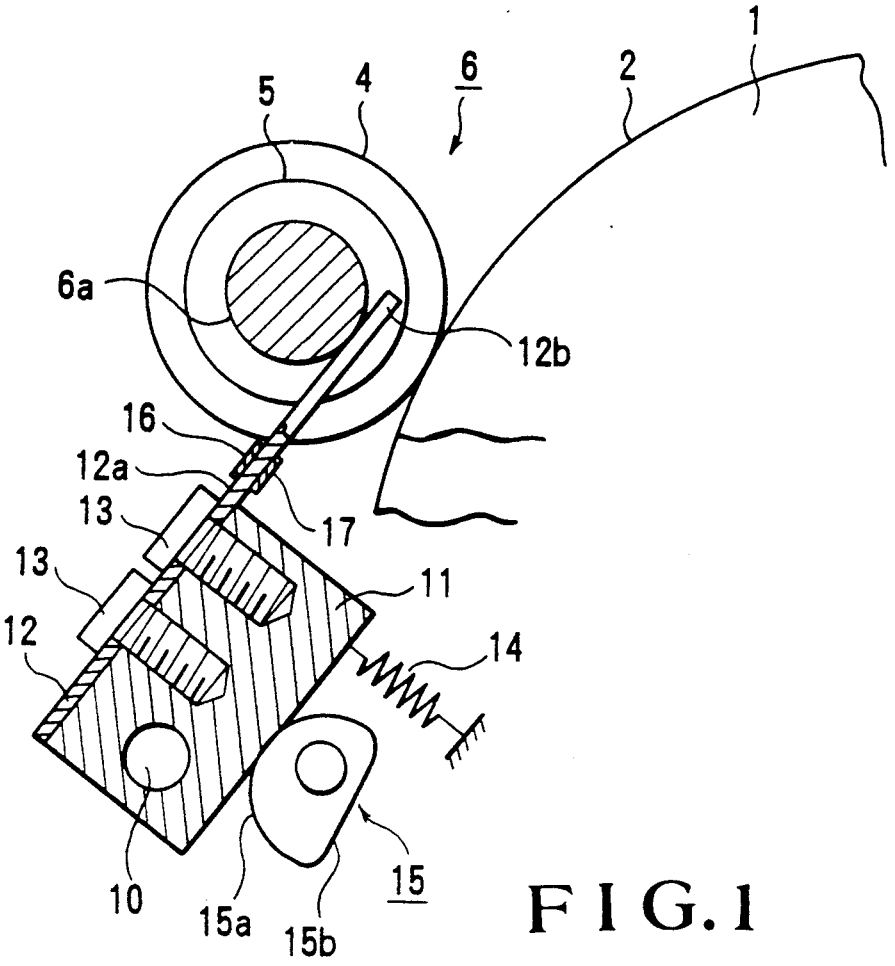
FIG. 1 is a side view of an apparatus for controlling a contact pressure between rotating members according to an embodiment of the present invention.
Figure 2:
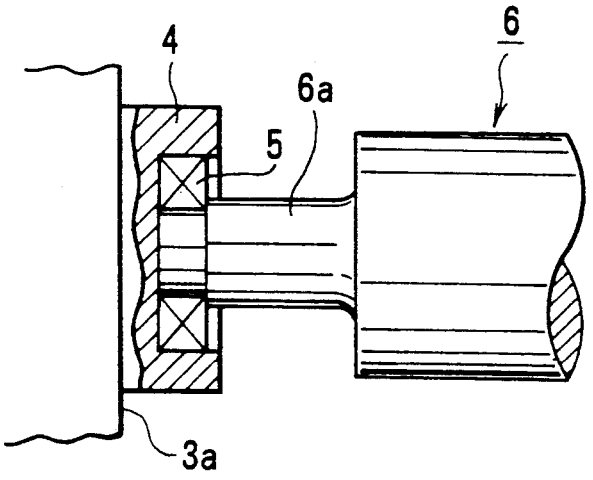
FIG. 2 is a partially sectional schematic front view of an end shaft portion of a form roller according to the embodiment of the present invention.
Figure 3:
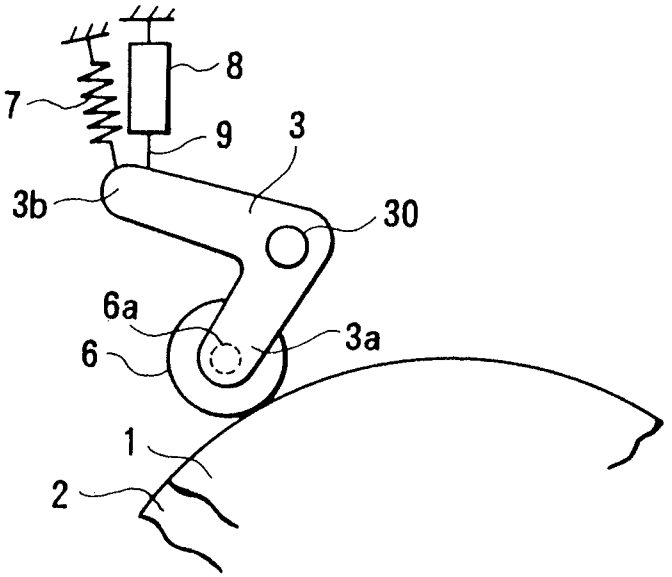
FIG. 3 is a schematic side view showing a roller arm and its vicinity according to the embodiment of the present invention.
Figure 4:
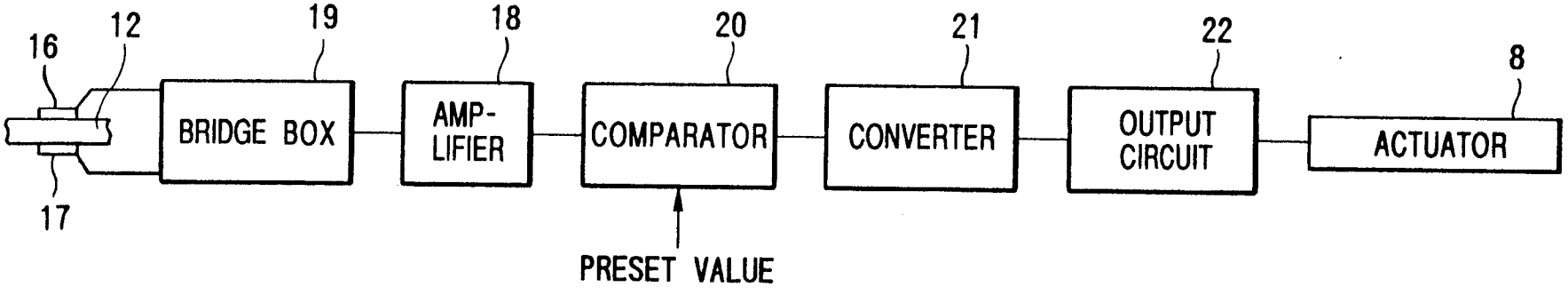
FIG. 4 is a schematic diagram showing the structure of the apparatus for controlling the contact pressure between rotating members according to the embodiment of the present invention.

FIGS. 1 to 4 show an arrangement in which an apparatus for controlling a contact pressure between rotating members according to an embodiment of the present invention is applied to an inking arrangement of a printing press, in which FIG. 1 shows the apparatus for controlling the contact pressure, FIG. 2 shows an end shaft portion of a form roller, FIG. 3 shows a roller arm and its vicinity, and FIG. 4 shows the schematic structure of the apparatus for controlling the contact pressure between the rotating members. Referring to FIGS. 1 to 4, a plate cylinder 1 is axially supported by bearings provided to the right- and left-side ink frames, and a plate 2 is mounted on the circumferential surface of the plate cylinder 1. An L-shaped roller arm 3 is pivotally and axially mounted on each of the right- and left-side ink frames (not shown) by a shaft 30.

A holder 4 is fixed on one free end portion 3*a* of each roller arm 3, and an end shaft 6*a* of a form roller 6 serving as one rotating member is fitted in the inner ring of a rolling bearing 5 having an outer ring fitted in the inner circumferential circle of the holder 4. A tension coil spring 7 extends between the other free end portion 3*b* of each roller arm 3 and a corresponding ink frame. The tension coil spring 7 supplies to the corresponding roller arm 3 a pivotal force to move the form roller 6 serving as one rotating member away from the surface of the plate cylinder 1 serving as the other rotating member on which the plate 2 is mounted. The free end portion 3*b* and the corresponding ink frame are coupled by an actuator 8 serving as a driving means. When the roller arm 3 is caused to swing by the forward/backward movement of a piston rod 9 of the actuator 8, the contact pressure between the form roller 6 and the surface of the plate 2 is adjusted. Referring to FIG. 3, the ink frame is simplified for the sake of illustrative convenience.

The contact pressure controlling apparatus will be described. A stud 10 is provided on each ink frame (not shown) in the vicinity of the form roller 6. A rectangular holder 11 is pivotally supported by the stud 10, and a plate 12 having a distal end portion connected to the end shaft 6*a* of the form roller 6 is fixed on the flat surface of the holder 11 by bolts 13. Furthermore, a tension coil spring 14 extends between the holder 11 and the ink frame (not shown) to supply to the holder 11 a pivotal force in a direction to move the plate 12 away from the end shaft 6*a*. In the vicinity of the holder 11, a cam 15 having a cam surface consisting of arcuated and linear portions 15*a* and 15*b* is pivotally axially supported to the ink frame such that its cam surface contacts the lower surface of the holder 11. When the cam 15 is pivoted, a distal end portion 12*b* of the plate 12 is positioned with respect to the end shaft 6*a* of the form roller 6.

A pair of strain gauges 16 and 17 serving as sensors are adhered to the two surfaces of a fixed base portion 12*a* of the plate 12 to oppose each other. When the contact pressure between the form roller 6 and the plate cylinder 1 is changed or is caused to have non-uniformity between the right- and left-side portions during the printing operation to dislocate the plate 12 connected to the end shaft 6*a*, one strain gauge 16 or 17 is strained in the compressive direction, and the other strain gauge 17 or 16 is strained in the tensile direction. This strain is detected as a force, and a corresponding signal is generated.

Referring to FIG. 4, the strain gauges 16 and 17 are connected to an amplifier 18 through a bridge box 19 that doubles and outputs the bending strain output, and the amplifier 18 is connected to a comparator 20. The comparator 20 is connected to a converter 21, and the converter 21 is connected to the actuator 8 through an output circuit 22.

With this arrangement, when the free end portion of the plate 12 is displaced, a compression strain occurs in one strain gauge 16 or 17 and a tensile strain occurs in the other strain gauge 17 or 16. This strain is supplied to the bridge box 19 to differentially become a signal indicating a force twice the bending strain, and this force is amplified by the amplifier 18 and input to the comparator 20. The comparator 20 compares the input signal value with a preset value stored in it. When there is a difference between the two values, a signal is sent to the converter 21. The converter 21 converts the signal from the comparator 20 to an operation target value. An operation command based on this target value signal is sent from the output circuit 22 to the actuator 8, and the actuator 8 moves the roller arm 3 by an amount corresponding to this command to finely adjust the form roller 6.

The operation of the apparatus for controlling the contact pressure between the rotating members which has the arrangement as described above will be described. When the printing operation is started, the ink in the ink fountain is uniformly distributed in the respective directions while it is transferred between the large number of rollers, and is supplied to the plate surface on the plate cylinder 1 by the form roller 6. Water is also supplied to the plate surface by the dampening arrangement (not shown). An image formed on the plate cylinder with the ink and water is transferred to the paper directly or through the blanket cylinder, thereby performing printing.

In this printing operation, when the contact pressure between, e.g., the form roller 6 and the plate surface of the plate cylinder 1 is increased to a value larger than a predetermined value, the plate 12 is urged by the end shaft 6*a* of the form roller 6 to slightly pivot clockwise in FIG. 1 about the stud 10. The tensile strain occurring in one strain gauge 16 and the compression strain occurring in the other strain gauge 17 are formed by the bridge box 19 into a signal indicating a force twice the bending strain, and is output.

A bending stress $\delta$ is represented by the following equation (1):

$$\delta = 2\epsilon \times 10^{-6} \times E \tag{1}$$

where E is the Young's modulus, and $2\epsilon$ is the strain amount.

A load (nip pressure) P is represented by the following equation (2):

$$\begin{aligned} P &= \delta Z/x \\ &= 2\epsilon EZ \times 10^{-6}/x \end{aligned} \tag{2}$$

where Z is the section modulus of the plate 12 and x is the distance between the distal end of the free end portion of the plate 12 and the strain gauge.

An output from the amplifier 18 is input to the comparator 20. The comparator 20 compares the input signal value with the preset value stored in it. When there is a difference between the two values, the comparator 20 outputs a signal to the converter 21. The converter 21 converts the signal from the comparator 20 into an operation target value of the actuator 8. An operation command based on this target value is output from the output circuit 22 to the actuator 8. The actuator 8 moves the roller arm 3 by an amount corresponding to the command to finely adjust the form roller 6, so that the contact pressure between the form roller 6 and the plate surface is corrected to the predetermined value.

In this embodiment, the roller arm 3 is exemplified as a support member to support one rotating member. However, the present invention is not limited to this. For example, the rotating member may be supported by an eccentric bearing, and the eccentric bearing may be pivoted to move the rotating member.

Also, in this embodiment, the plate 12 as a plate-like member is swingably supported through the holder 11. However, the plate 12 may be supported by, e.g., an actuator that moves linearly.

Furthermore, in this embodiment, the roller arm 3 as a means for generating a contact pressure between the rotating members is swung by the actuator 8. However, the roller arm 3 may be linearly moved by an actuator.

This embodiment exemplifies a case in which the present invention is applied to the inking arrangement of a rotary press. However, the present invention can similarly be applied to a dampening arrangement of the printing press, an apparatus for controlling the printing pressure between cylinders, and a rotating member of a machine other than the printing press to obtain a similar effect. A rotating member includes various types of rollers and a large-diameter hollow roller which is generally called a cylinder.

As is apparent from the above description, according to the present invention, in an apparatus for controlling the contact pressure between the rotating members, one rotating member is supported by a support member so as to be movable toward and away from the other rotating member. The support member is moved by a driving means so that the moving rotating member applies a contact pressure to the other rotating member. A plate-like member connected to the end shaft portion of the moving rotating member is supported on the machine frame. A displacement in the plate-like member is detected by a sensor, and a signal corresponding to the displacement is generated. In this manner, since the contact pressure between the rotating members can be detected as a unit of force, the contact pressure can be precisely corrected, thereby improving the printing quality.

Furthermore, a comparator for comparing a signal, which is output from a sensor that generates the signal upon detection of a displacement of the plate-like member, with a preset value and generating a signal, and a driving means driven by the signal from the comparator are provided. Therefore, the contact pressure can be detected as a unit of force, and the fluctuation in the contact pressure during the printing operation can be directly displayed. Hence, the fluctuation in the contact pressure can be precisely corrected, thereby improving the printing quality.

What is claimed is:

1. An apparatus for controlling a contact pressure between rotating members, comprising:

a first rotating member;

a second rotating member applying the contact pressure to said first rotating member and having an end shaft portion;

a support member for supporting said second rotating member to be movable with respect to said first rotating member;

a driving means for moving said support member so as to adjust said contact pressure applied by said second rotating member to said first rotating member;

a plate-like member brought into contact with said end shaft portion of said second rotating member;

a sensor for detecting a displacement of said plate-like member to generate a signal;

a holding member for holding said plate-like member;

a machine frame for pivotally supporting said holding member;

a spring member for applying a biasing force to said holding member causing said plate-like member to be separated from said second rotating member; and an adjusting member for moving said holding member against said biasing force of said spring member to position said plate-like member in contact with said second rotating member.

2. An apparatus according to claim 1, further comprising comparing means for comparing said signal from said sensor with a preset value, and wherein said driving means is driven in accordance with a comparison result of said comparing means.

3. An apparatus according to claim 2, further comprising driving amount determining means for determining a driving amount of said driving means on the basis of the comparison result of said comparing means, and wherein said driving means is slightly driven based on the driving amount determined by said driving amount determining means.

4. An apparatus according to claim 1, wherein said support member comprises and L-shaped roller arm having first and second free end portions and axially supported to rotate in a direction to separate from said first rotating member, said second rotating member is rotatably axially supported on said first free end portion, and said driving means is coupled between said second free end portion and said machine frame in a direction against rotation of said L-shaped roller arm.

5. The apparatus of claim 1, wherein said biasing force causes said holding member to rotate in a direction to separate said plate-like member from said second rotating member.

6. The apparatus of claim 5, wherein said adjusting member swings said holding member against said biasing force of said spring member to position said plate-like member in contact with said second rotating member.

* * * * *